US008412420B2

(12) United States Patent
Ruhter et al.

(10) Patent No.: US 8,412,420 B2
(45) Date of Patent: Apr. 2, 2013

(54) WHEEL LEAN CONTROL

(75) Inventors: Martin L. Ruhter, Dubuque, IA (US); Brent A. Smith, Peosta, IA (US)

(73) Assignee: Deere & Company, Moline, IL (US)

( * ) Notice: Subject to any disclaimer, the term of this patent is extended or adjusted under 35 U.S.C. 154(b) by 311 days.

(21) Appl. No.: 12/967,926

(22) Filed: Dec. 14, 2010

(65) Prior Publication Data

US 2012/0150390 A1 Jun. 14, 2012

(51) Int. Cl.
*G06F 7/70* (2006.01)

(52) U.S. Cl. ..... 701/50; 701/42; 280/5.521; 180/215

(58) Field of Classification Search ..... 701/42, 701/48, 50; 280/5.521, 301; 180/21, 215
See application file for complete search history.

(56) References Cited

U.S. PATENT DOCUMENTS

| | | | | |
|---|---|---|---|---|
| 3,759,333 | A | 9/1973 | Rivinius | |
| 3,783,966 | A | 1/1974 | Campbell et al. | |
| 5,584,346 | A | 12/1996 | Sakamoto et al. | |
| 6,152,237 | A | 11/2000 | Hartman et al. | |
| 7,497,298 | B2 | 3/2009 | Shearer et al. | |
| 7,673,883 | B2 | 3/2010 | Damm | |
| 2008/0202111 | A1 | 8/2008 | Harber et al. | |
| 2010/0114430 | A1 * | 5/2010 | Thomson et al. | 701/41 |

FOREIGN PATENT DOCUMENTS

JP 52081825 A1 7/1977

OTHER PUBLICATIONS

Background Information (2 pages).

* cited by examiner

*Primary Examiner* — Thomas Black
*Assistant Examiner* — Luke Huynh

(57) ABSTRACT

A work vehicle comprises a leanable traction wheel. A control unit of the work vehicle is configured to cause the wheel to move to a wheel-lean angle setpoint.

20 Claims, 5 Drawing Sheets

WHEEL LEAN CONTROL

FIELD OF THE DISCLOSURE

The present disclosure relates to a work vehicle, such as a motor grader, with leanable wheels.

BACKGROUND OF THE DISCLOSURE

A typical motor grader has two front traction wheels (a left and a right) which can lean relative to neutral to one side or the other such that each front wheel assumes a present wheel-lean angle from neutral. Wheel-lean is provided in order to counter-act side-draft (i.e., lateral forces) caused by a moldboard angle of the moldboard of the motor grader. Extra weight on the front end can also be used to help counter-act side-draft.

Moldboard angle may be used in a variety of applications, ditching (i.e., cutting a ditch) and road maintenance (e.g., snow removal) being but two examples. Ditching typically involves large lateral forces, more so than typical road maintenance involving less material, and thus calls for more wheel lean than road maintenance. For example, it is known for an operator to perform a first job at a first job site (e.g., ditching) using wheel lean at a first wheel-lean angle, transition to a second job site with zero wheel lean (e.g., traveling over the road), and perform a second job at a second job site (e.g., road maintenance) with wheel lean at a second wheel-lean angle different from the first wheel-lean angle. Wheel lean is sometimes changed when turning between passes to sharpen the turn. Wheel lean is also used to make small steering corrections.

Neutral may assume a variety of orientations. It is known for neutral to be a normal to the surface on which the front wheels are positioned (e.g., the ground), the normal being vertical in the case of a flat, horizontal surface. It is also known for the front wheels to be designed with a positive camber at neutral (e.g., 0.21 degree) in order, for example, to lower the steering effort. In some graders, the camber of neutral is fixed. In other graders, the camber of neutral is adjustable.

The front wheels of a typical motor grader are leanable from neutral in order to change a present wheel-lean angle of the front wheels. With respect to each front wheel, a zero present wheel-lean angle means that the center-line of the wheel running through the top and bottom of the wheel is at neutral such that the present-wheel lean angle of the wheel relative to neutral is zero degrees. A non-zero present wheel-lean angle means that the wheel center-line is leaning or angled laterally to the left or right from neutral.

It is known for the front wheels to be connected to one another for coordinated wheel-lean of the front wheels. In some motor graders, a front axle is coupled pivotally to the main frame of the front section of the motor grader. At each end of the front axle is a yoke coupled pivotally to the axle. The left and right yokes are coupled pivotally respectively to left and right spindles using respective upper and lower kingpins. The left and right spindles are fastened respectively to left and right final drives, which are, in turn fastened respectively to the left and right front wheels. A hydraulic wheel-lean cylinder is coupled pivotally to the front axle and to, for example, the left yoke. The front wheels are connected to one another via a wheel-lean bar coupled to the yokes such that extension or retraction of the wheel-lean cylinder causes the present wheel-lean angles of the front wheels to change. The front wheels are thus coupled to opposite ends of a front axle to move relative thereto to lean at a present wheel-lean angle from neutral.

A human operator can control wheel lean from the operator's station with an input device (e.g., a control lever), by relying on visual references. For example, a type of visual indicator has a mark on the front axle and a mark on the wheel-lean bar. Relative alignment or misalignment of the marks provides a visual indication of wheel lean.

In another example, operators have estimated wheel lean from observation of one or both of the wheels. Operator feedback of premature tire wear resulted in a past solution that reduced the amount of positive camber in the front wheels at neutral, to address situations where an operator may be returning one of the wheels to vertical while the other wheel is leaning (considering that a system with front wheel camber of a degrees at neutral would result in a wheel lean of $2\alpha$ at one wheel if the other wheel is returned to vertical).

When the operator attempts to return the wheels to neutral by use of such visual references, the wheels sometimes end up leaning away from neutral due to inherent accuracy limitations of these methods. If the wheels are leaned away from neutral, pre-mature tire wear can result when roading a motor grader at high speeds on, for example, concrete or asphalt surfaces or other wear-inducing surfaces.

SUMMARY OF THE DISCLOSURE

According to an aspect of the present disclosure, there is provided work vehicle comprising an axle, a traction wheel coupled to the axle to move relative thereto to lean at a present wheel-lean angle from neutral, a wheel-lean angle sensor positioned to sense an indication of the present wheel-lean angle, a setpoint activation control, a wheel-lean actuator coupled to the traction wheel to lean the traction wheel relative to neutral, and a control unit coupled to the wheel-lean angle sensor, the setpoint activation control, and the wheel-lean actuator. The control unit is configured to perform feedback control of the present wheel-lean angle causing the wheel-lean actuator to move the traction wheel automatically such that the present wheel-lean angle assumes a wheel-lean angle setpoint in response to operation of the setpoint activation control.

With such a system, a human operator can operate the setpoint activation control to cause the wheel to assume the wheel-lean angle setpoint without use of visual references. For example, the wheel-lean angle setpoint may be stored as a zero wheel-lean angle (i.e., on neutral which may be, for example, vertical or near vertical), in which case the wheel is moved to neutral in response to operation of the setpoint activation control, minimizing pre-mature wear of the tires. In other examples, the wheel-lean angle setpoint may be stored as a non-zero wheel-lean angle for a particular job (e.g., ditching, road maintenance). In yet other examples, it may be useful to store multiple wheel-lean angle setpoints, for different operating modes.

The above and other features will become apparent from the following description and the attached drawings (welds and hoses not shown in drawings, but understood).

BRIEF DESCRIPTION OF THE DRAWINGS

The detailed description of the drawing refers to the accompanying figures in which.

DETAILED DESCRIPTION OF THE DRAWINGS

Figure 1:
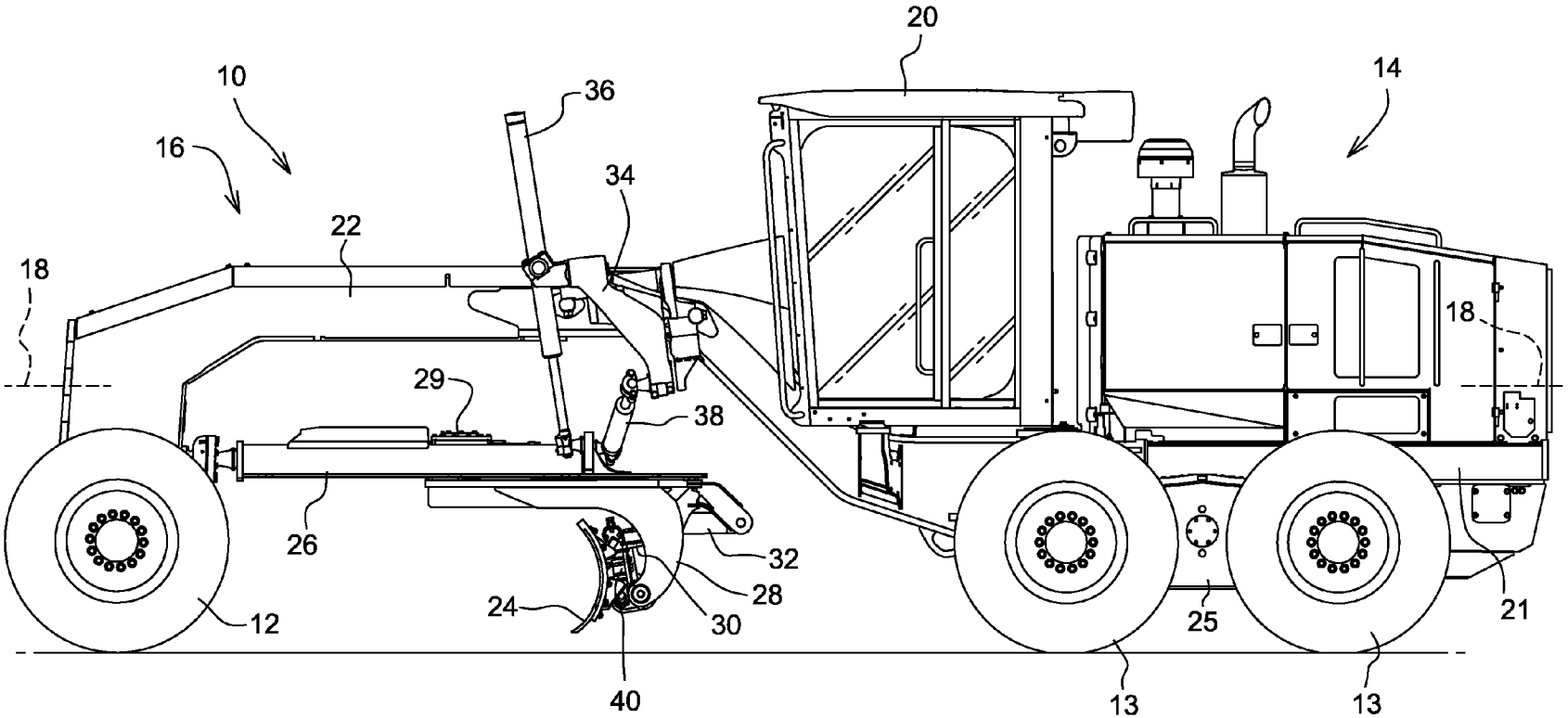
FIG. 1 is a side elevation view of a work vehicle in the form of, for example, a simplified motor grader with leanable front traction wheels.

Referring to FIG. 1, there is shown a work vehicle 10 in the form of, for example, a motor grader which has two leanable front traction wheels 12 and four non-leanable rear traction wheels 13.

The vehicle 10 has rear and front sections 14, 16. The engine frame 21 of the rear section 14 and the main frame 22 of the front section 16 are articulated to one another at an articulation joint 17 (shown diagrammatically in FIG. 6A) for steering of the vehicle 10 left and right using a left articulation cylinder and a right articulation cylinder, the articulation cylinders coupled to and extending between the rear and front sections 14, 16. Terms such as "left" and "right" are relative to a central fore-aft axis 18 of the vehicle 10.

The rear section 14 has the internal combustion engine (e.g., diesel engine) of the vehicle 10 and a tandem 25 on each side of the vehicle 10, only the left tandem being shown. Each tandem 25 has two traction wheels 13 that may be driven by the engine of the vehicle 10 through a transmission for propulsion of the vehicle 10, each tandem 25 having a chain drive with two chains each between a tandem axle and a respective wheel 13. The rear section 14 thus has four of the six traction wheels of the vehicle 10, two on the left with one in front of the other and two on the right with one in front of the other.

The front section 16 has an operator's station 20 from which a human operator can control the vehicle 10. The operator's station 20 is supported on the main frame 22 of the front section 16.

The front section 16 has a moldboard 24 mounted to the main frame 22 of the front section 16. The moldboard 24 is configured for moving earthen or other material.

The moldboard 24 is mounted for movement in a number of directions. A draft frame 26 is coupled to the main frame 22 toward the front via a ball-and-socket joint. A circle frame 28 is coupled to the draft frame 26 to rotate relative thereto by use of a circle drive 29 mounted to the draft frame 26. A tilt frame 30 holds the moldboard 24 and is coupled pivotally to the circle frame 28 for pivotal movement of the tilt frame 30 and the moldboard 24 held thereby relative to the circle frame 28 about a tilt axis by use of a tilt cylinder 38. The tilt cylinder 32 is connected to the circle frame 28 and the tilt frame 30 therebetween to change the pitch of the tilt frame 30, and thus the moldboard 24, relative to the circle frame 28. The moldboard 24 is coupled to the circle frame 28 through the tilt frame 30 to rotate with the circle frame 28 relative to the draft frame 26.

A saddle 34 is mounted to the main frame 22. Left and right blade-lift cylinders 36 (only the left blade-lift cylinder is shown) are connected to the saddle 34 and the draft frame 26 therebetween for raising and lowering the sides of the draft frame 26, and thus the moldboard 24, relative to the main frame 22. A circle side-shift cylinder 38 is connected to the saddle 34 and the draft frame 26 therebetween to side-shift the draft frame 26 and circle frame 28, and thus the moldboard 24, relative to the main frame 22.

A moldboard side-shift cylinder 40 is connected to the tilt frame 30 and the moldboard 24 therebetween. The cylinder 40 is operable to move the moldboard 24 in translation relative to the tilt frame 30 along a longitudinal axis of the moldboard 24.

Figure 2:
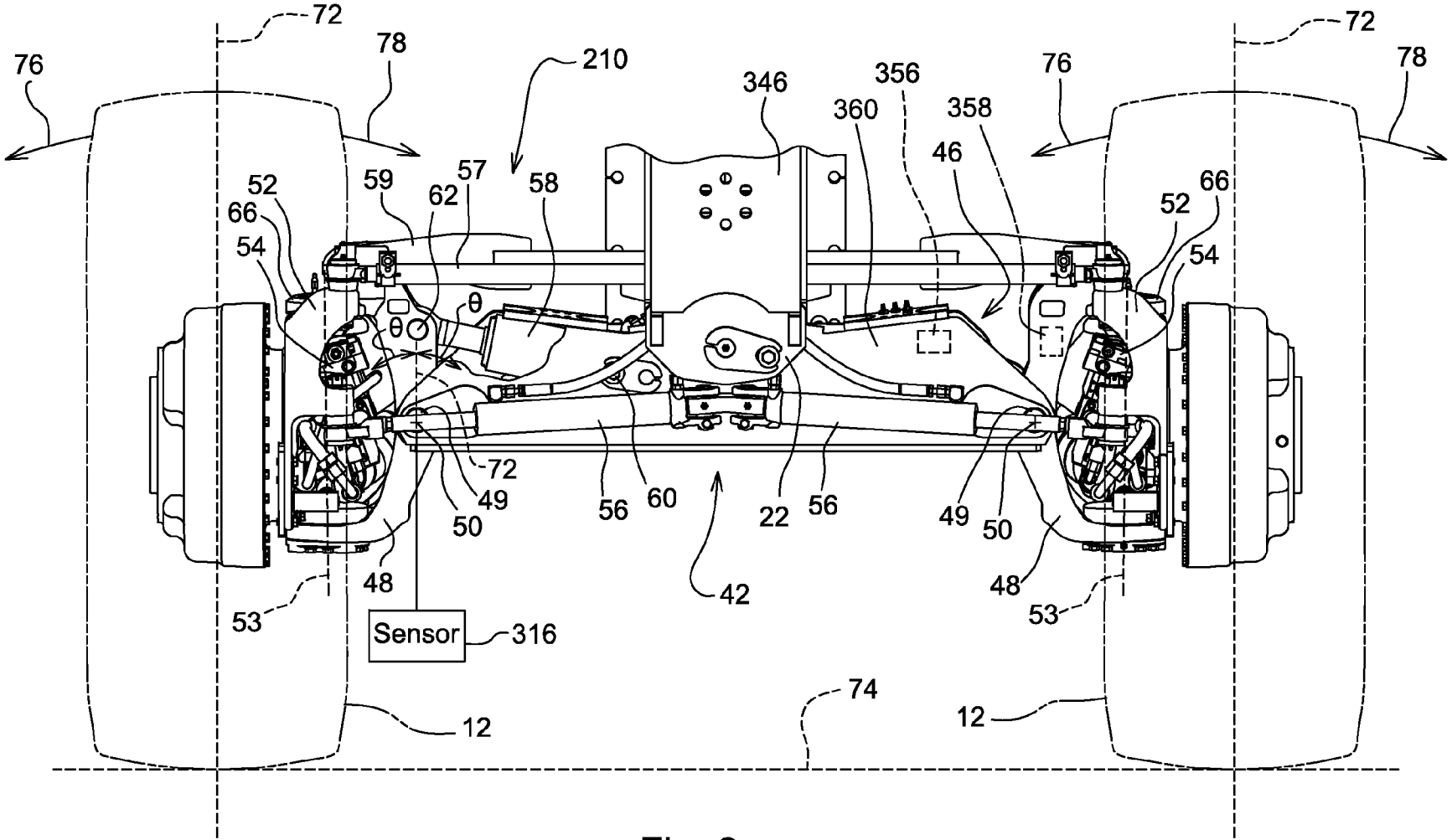
FIG. 2 is a rear elevation view showing a front wheel assembly and the front wheels positioned at a zero wheel-lean angle.

Referring to FIG. 2, the front section 16 has two front traction wheels 12, a left front traction wheel and a right front traction wheel. The front wheels 12 may be propelled, steered, and leaned hydraulically.

The front wheels 12 are coupled to the main frame 22 by use of a front wheel assembly 42. The front wheel assembly 42 includes a front axle 46, a center portion of which is coupled pivotally (e.g., pinned) to the main frame 22. At opposite ends of the axle 46, a yoke 48 is coupled pivotally to the axle 46 by use of, for example, a pin 49 for pivotal movement about a yoke axis 50 defined by the pin 49. The left yoke 48 is coupled pivotally to a left spindle 52 by use of an upper kingpin and a lower kingpin for steering of the left wheel 12 about a wheel steering axis 53 defined by those kingpins (the left upper and lower kingpins providing a left front wheel steering joint 66), and the right yoke 48 is coupled pivotally to a right spindle 52 by use of an upper kingpin and a lower kingpin for steering of the right wheel 12 about a wheel steering axis 52 defined by those kingpins (the right upper and lower kingpins providing a right front wheel steering joint 66 shown diagrammatically in FIG. 6B). The left and right spindles 52 are fastened respectively to left and right gear-reducing final drives, which are, in turn fastened respectively to the left and right front wheels 12.

The wheels 12 are driven hydraulically in forward and reverse directions. A left hydraulic motor 54 is mounted to the left spindle 52 and is operatively coupled to the left final drive to rotate the left wheel 12. A right hydraulic motor 54 is mounted to the right spindle 52 and is operatively coupled to the right final drive to rotate the right wheel 12. The vehicle 10 may thus have dual-path hydrostatics such that each front wheel 12 has associated with it a dedicated motor 54 and a dedicated pump (not shown).

The front wheel assembly 42 includes a left front steering cylinder 56 and a right front steering cylinder 56 which are configured to steer the left and right front wheels 12, respectively. Each front steering cylinder 56 is coupled at one end to the axle 46 and at an opposite end to the respective spindle 52 to rotate the respective wheel 12 about its steering axis 53. A tie rod 57 is connected to the left and right spindles 52 therebetween for coordinated steering movement of the wheels 12.

The front wheel assembly 42 is thus configured such that the left and right front wheels 12 trace out circles of different radii when the front wheels 12 are turned relative to their respective steering-neutral positions about their respective steering axes, discouraging skidding of the front wheels 12 (compared to if the front wheels 12 were on the same radii). As such, when the left and right front wheels 12 are steered to the left or right about their respective steering axes 53, the wheels 12 assume different steering angles, the inner wheel turning at a greater angle than the outer wheel.

The front wheels 12 are configured to lean together relative to neutral. A hydraulic wheel-lean cylinder 58 is coupled pivotally to the front axle 46 by use of a pin 60 and to the left yoke 48 by use of a pin 62. The front wheels 12 are connected to one another via a wheel-lean bar 59. The wheel-lean bar 59 is coupled pivotally to the upper portion of the left yoke 48 and to the upper portion of the right yoke 48 so as to extend between the yokes 48. Extension or retraction of the wheel-lean cylinder 58 pivots the left yoke 48 about its axis 50 and the right yoke 48 about its axis 50 via the wheel-lean bar 59, causing a present wheel-lean angle (θ) of the front wheels 12 to change. The front wheels 12 are thus coupled to the axle 46 to move relative thereto to lean at a present wheel-lean angle (θ) in response to operation of the wheel-lean cylinder 58. Since the front wheels 12 pivot respectively about the yoke axes 50, the present wheel-lean angle is referenced to such an axis 50, shown in connection with the left yoke axis 50 in FIG. 3 for sake of illustration.

The present wheel-lean angle is referenced to neutral. At neutral, the present wheel-lean angle is zero, i.e., θ=0°. Neutral may assume a variety of orientations. In the illustrated embodiment, neutral (72 in FIG. 3) may coincide with a normal to the surface 74 on which the front wheels 12 are positioned (e.g., the ground), the normal being vertical in the case of a flat, horizontal surface, such that the front wheels 12 have zero camber at neutral. In another embodiment (preferred), the front wheels 12 have a positive camber at neutral (e.g., 0.21 degree) in order, for example, to lower the steering effort, tending to the make the machine go straight (a desired degree of camber can be selected by choosing a wheel-lean bar 59 with a corresponding length). Neutral is shown as vertical line 72 passing through a yoke axis 50 (illustratively the left yoke axis 50), since the front wheels 12 pivot respectively about the yoke axes 50. It may also be helpful to think of neutral as passing respectively through the wheels 12, and moving with the wheels 12 as they pivot while staying in the same orientation with respect to the surface 74. Neutral is thus also shown as a vertical line 72 passing through the wheels 12.

Each wheel 12 is configured to lean laterally (left and right) from neutral as indicated by left arrows 76 and right arrows 78. For example, the wheels are configured to lean 20 degrees to the left of the normal to the surface on which the front wheels are positioned (or from neutral) and 20 degrees to the right of that normal (or from neutral).

The aforementioned structure of the wheel assembly 42 used to lean the front wheels 12 is included in an exemplary wheel-lean actuator 210. Other components of the actuator 210 are discussed in connection with FIG. 3.

Figure 3:
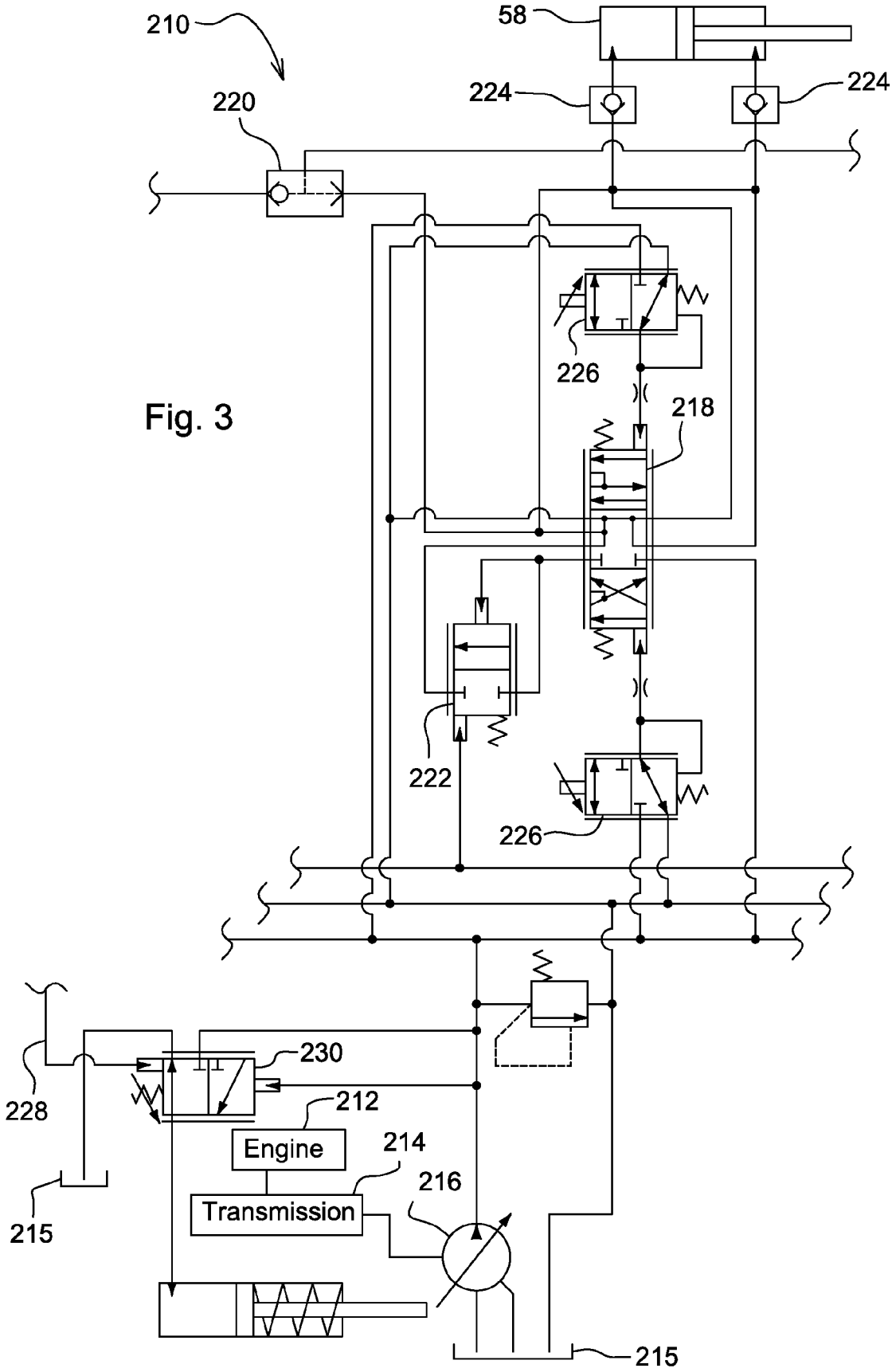
FIG. 3 is a schematic view showing a hydraulic system of a wheel-lean actuator.

Referring to FIG. 3, the wheel-lean actuator 210 is coupled to the front wheels 12 to lean them relative to neutral and thus relative to the front axle 46. The wheel-lean actuator 210 includes the wheel-lean portion of the hydraulic system of the vehicle 10. The vehicle 10 has a hydraulic system that exemplarily serves several hydraulic functions of the vehicle 10, including the wheel-lean function. The hydraulic system is configured, for example, as a pressure-compensated load-sense hydraulic system that is powered by the internal combustion engine 212 of the vehicle 10 (e.g., diesel engine) via a transmission 214 (or gearbox) of the vehicle 10. The hydraulic system includes a pump 216 so powered. In other examples, the pump 216 may be driven by an electric motor, such as one that may be powered by an electric generator driven by the engine.

The pump 216 is configured, for example, as a variable displacement, axial piston pump (e.g., displacement up to 90 cubic centimeters) that may be gravity-fed with hydraulic fluid (e.g., hydraulic oil) from a tank 215 and may supply pressurized hydraulic fluid for several hydraulic functions of the vehicle 10, including the wheel-lean function. As such, the pump 216 is considered part of the actuator 210.

The actuator 210 includes a wheel-lean section in a valve bank of the vehicle 10. The wheel-lean section includes a pilot-controlled, proportional directional control valve 218, a load-sense shuttle check valve 220, a compensator valve 222, a pair of lock-out valves 224, and a pair of proportional electro-hydraulic pilot valves 226. The control valve 218 has a spool configured to move between a closed-center neutral position and opposite extreme positions to direct flow of hydraulic fluid to and from the head and rod work ports of the wheel-lean cylinder 58. The pilot valves 226 are coupled fluidly respectively to opposite pilot ports of the control valve 218 and are responsive to control signals from a controller to pilot the control valve 218. Alternatively, an on/off poppet valve could be used in place of the directional control valve 218 and the pilot valves 226. Further alternatively, an electric linear actuator could be used in place of the cylinder 58.

The shuttle check valve 220 is one of a series of shuttle check valves associated respectively with various hydraulic functions. Each shuttle check valve compares two pressures (e.g., two work port pressures associated with different hydraulic functions, or one such work port pressure and the other tank) so as to select the highest pressure among the functions, this pressure being provided as such or in representative form (e.g., pressure reduced across fixed orifice) as the load-sense pressure via a load-sense line 228 to a proportional valve 230 configured to establish a predetermined load-sense margin (e.g., 420 psi).

The normally closed compensator valve 222 has a pilot port coupled fluidly to the control valve 218 to receive pressure therefrom as the control valve 218 opens and an opposite pilot port coupled fluidly to the load-sense pressure and corresponding pilot ports of the compensator valves associated with other hydraulic functions. Collectively, the compensator valves divide flow so that all actuated hydraulic functions receive hydraulic fluid when multiple directional control valves are actuated.

The lock-out valves 224 trap the hydraulic fluid in the cylinder 58 so that the cylinder 58 does not move until the control valve 218 is opened. The lock-out valves 224 open in response to opening of the control valve 218, allowing movement of the cylinder 58.

Figure 4:
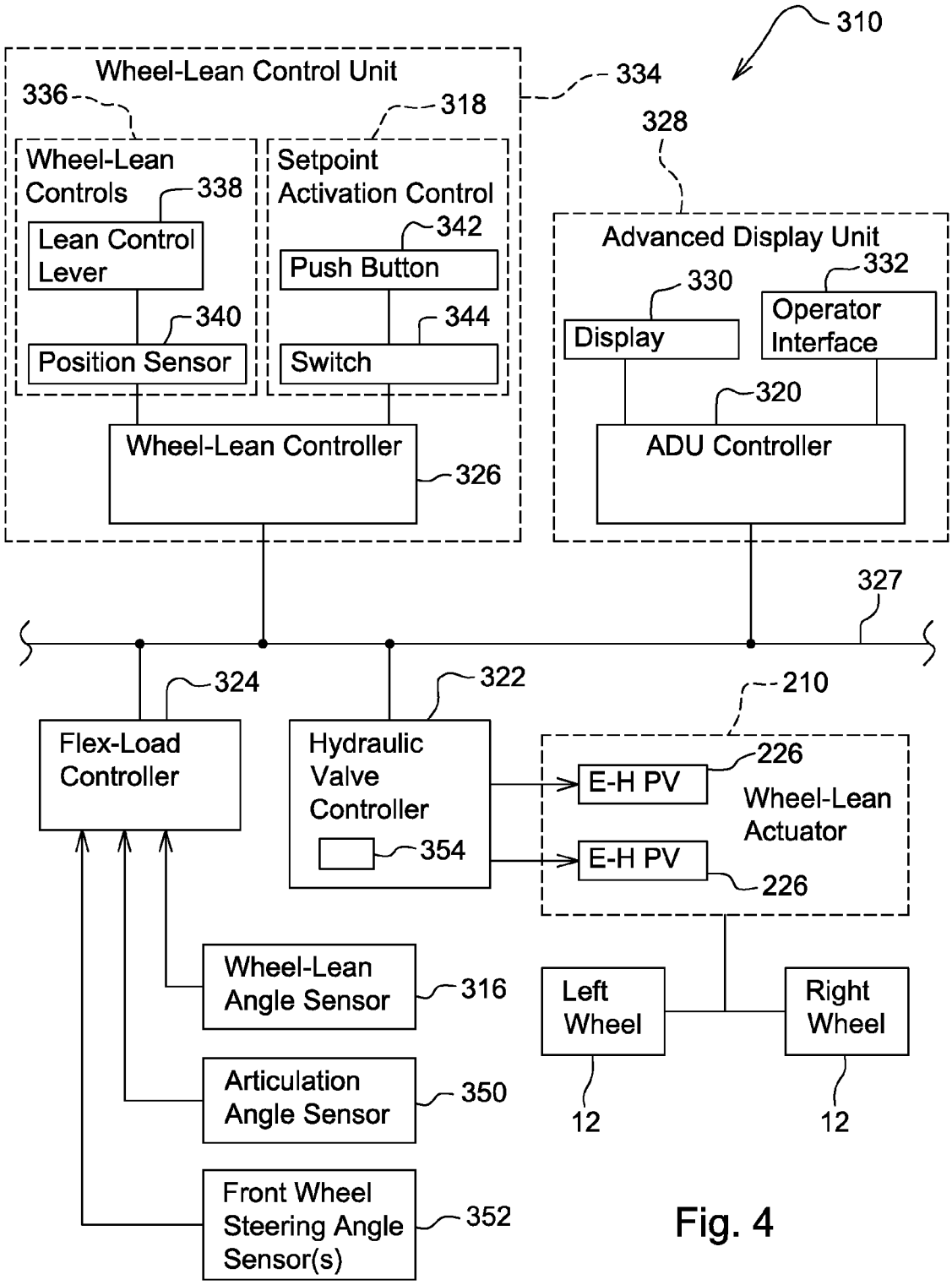
FIG. 4 is a schematic view of a simplified control unit.

Referring to FIG. 4, there is shown a simplified control unit 310 of the vehicle 10. The control unit 310 may include one or more electronic controllers. Exemplarily, the control unit 310 includes a network of such controllers connected via CAN ("Controller Area Network"). In other embodiments, the control unit 310 may include a single electronic controller.

Each electronic controller includes sufficient processor technology and memory to perform the various activities of the controller. For example, each controller may include a processor (e.g., microprocessor) and memory coupled electrically to the processor, the memory unit having stored therein instructions which, when executed by the processor, cause the processor unit to perform the various activities of the controller.

The control unit 310 is coupled electrically to a wheel-lean angle sensor 316, a setpoint activation control 318, and the wheel-lean actuator 210. The wheel-lean angle sensor 316 is positioned to sense an indication of the present wheel-lean angle. The setpoint activation control 318 is operable by the operator to request that the present wheel-lean angle of the front wheels 12 assume a wheel-lean angle setpoint. The setpoint may be a zero wheel-lean angle (i.e., 0 degrees relative to neutral so as to be on neutral). Non-zero wheel-lean angles can be selected, if desired. For example, a suitable non-zero wheel-lean angle may be selected based on the particular job to be performed by the vehicle 10, such as, for example, ditching or road maintenance.

The control unit 310 is configured to perform feedback control of the present wheel-lean angle causing the wheel-lean actuator 210 to move the traction wheel 12 automatically such that the present wheel-lean angle assumes a wheel-lean angle setpoint in response to operation of the setpoint activation control 318. The control unit 310 signals the actuator 210 to so move the wheels 12. The control unit 310 is configured to: store the wheel-lean angle setpoint, receive one or more signals indicative of the present wheel-lean angle in response to operation of the wheel-lean angle sensor 316 and a wheel-lean request signal indicative of a request that the present wheel-lean angle assume the wheel-lean angle setpoint in response to operation of the setpoint activation control 318, determine if the present wheel-lean angle is at the wheel-lean angle setpoint in response to the wheel-lean request signal, and, if not, output a control signal causing the wheel-lean actuator 210 to move the wheels 12 such that the present wheel-lean angle assumes the wheel-lean angle setpoint. In this way, the front wheels 12 can be moved automatically to the setpoint by simple operation of the control 318.

Various predetermined criteria may be used to determine if the present wheel-lean angle is "at" or "assumes" (or words to that effect) the wheel-lean angle setpoint. For example, the present wheel-lean angle is deemed to be "at" or to "assume" (or words to that effect) the wheel-lean angle setpoint if the present wheel-lean angle is within a predetermined tolerance about the wheel-lean angle setpoint (e.g., + or −0.25 degree from the setpoint).

Exemplarily, the control unit 310 has a plurality of electronic controllers. For example, the control unit 310 may include an advanced display unit controller (ADUC) 320, a hydraulic valve controller (HVC) 322, a flex load controller (FLC) 324, a wheel-lean controller (WLC) 326, and possibly other controllers. Such controllers may be coupled electrically to one another via, for example, a CAN bus 327.

Figure 5:
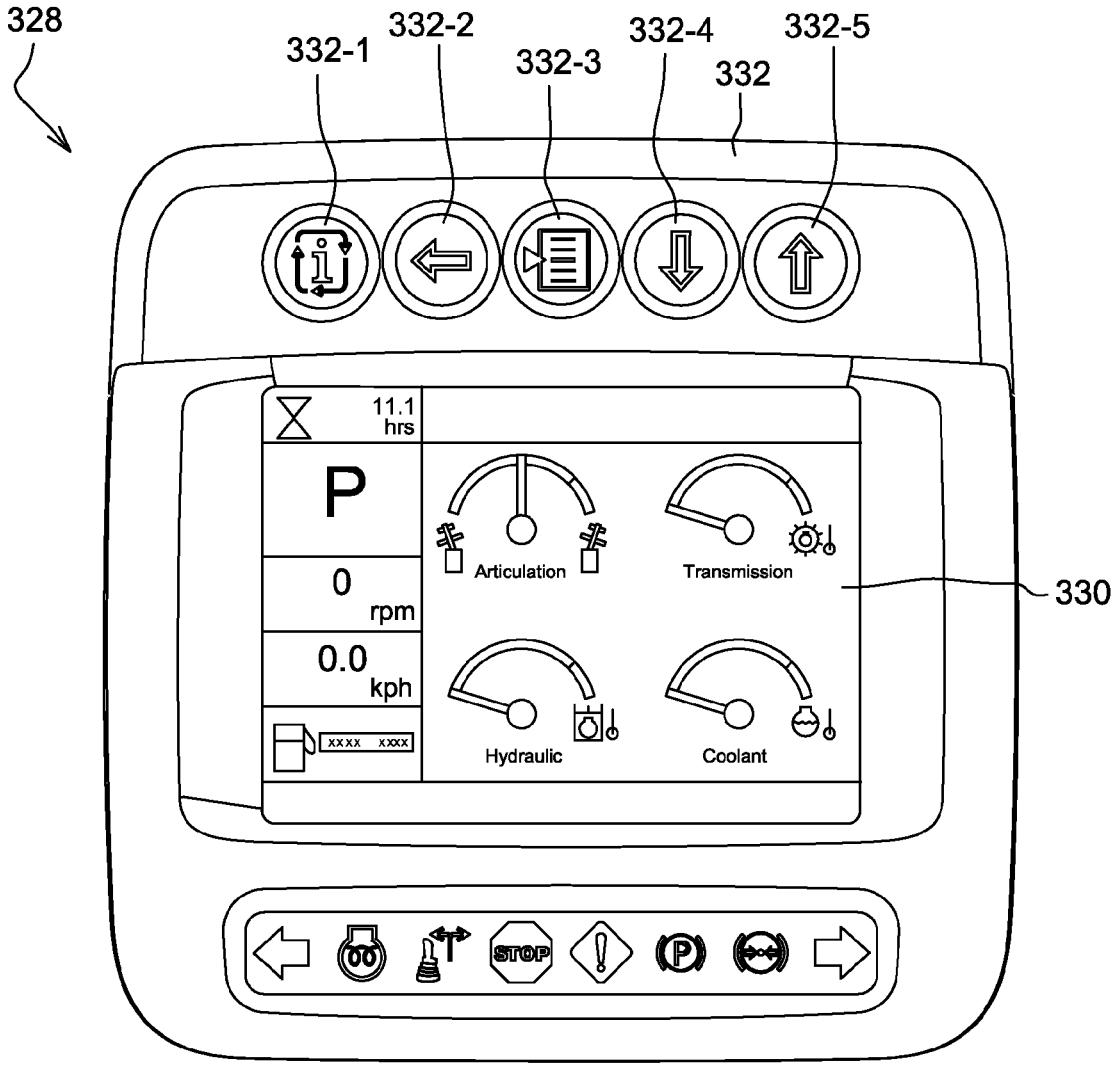
FIG. 5 is an elevation view of an advanced display unit.

Referring to FIG. 5, the ADUC 320 is included in an advanced display unit 328. The unit 328 includes a display 330 (e.g., LCD color display) and an operator interface 332, and may be mounted in any suitable location in the operator's station 20, such as, for example atop the front steering console or to a post on the right side of the operator's station 20. The operator interface 332 is configured to receive the wheel-lean angle setpoint from the operator. The operator may use the operator interface 330 to input the wheel-lean angle setpoint into the control unit 310. The setpoint is stored in the memory of the ADUC 320, and the ADUC 320 broadcasts a signal indicative of the setpoint on the CAN bus 327. The signal is received by the HVC 322.

The operator interface 332 may have a number of push buttons mounted to the display 330. The push buttons may be aligned along the top of the display 330 and may include a screen swap button 332-1, a back button 332-2, a menu/select button 332-3, a down button 332-4, and an up button 332-5, each of which may be back-lit. The screen swap button may toggle the screen of the display 330 between a number of screens, such as, for example, a gauge screen, a rearview camera screen, and an embedded cross slope system screen. In the gauge screen, the display 330 may display, for example, analog-looking temperature (transmission, hydraulic, and engine coolant) and articulation gauges, gear selection, engine speed, ground speed, fuel level, hours of operation, ambient temperature, odometer, and the like. The menu/select button is used to go to the main menu, and allows selection of a highlighted menu item or store a value set in the memory of the ADUC 320. The back button reverts to the previous screen when viewing a particular menu. The down button highlights the next item in a menu or decreases a value being stored. The up button highlights the previous item in a menu or increases a value being stored. It is understood that a wide variety of operator interfaces could be used.

The operator may input the wheel-lean angle setpoint using the ADU 328. For example, at the main menu, the operator may select a set-up menu screen (e.g., machine settings) with the menu/select button, and, at such menu screen, select wheel-lean angle with the menu/select button.

At the wheel-lean angle selection screen, the operator may use the up and down buttons to enter a wheel-lean angle. For example, the up and down buttons may be used to scroll between a number of setpoint options in order to highlight the setpoint desired. In another example, the up and down buttons may be used to increment and decrement a setpoint value until the desired setpoint is displayed. The increment/decrement interval may be 0.1 degree or greater, such as, for example, 0.5 degree.

Once the desired setpoint is entered, the operator may select that setpoint to be the wheel-lean angle setpoint by pressing the menu/select button, generating a setpoint signal indicative of that value. This signal is received by the ADUC 320, and may be stored therein. The ADUC 320 broadcasts a signal on the CAN bus 327 indicative of the wheel-lean angle setpoint. This signal is received by the HVC 322 which stores the wheel-lean angle setpoint in its memory. The wheel-lean angle setpoint may be displayed by the display 330 in, for example, a menu set-up screen of the display 330 (e.g., machine settings). In another example, the wheel-lean angle setpoint may appear on a different screen (e.g., on the gauge screen or other screen), such as if the setpoint is at neutral or full-travel left or right or anywhere in between.

Referring back to FIG. 4, a wheel-lean control unit 334 includes the WLC 326, the setpoint activation control 318, and a wheel-lean control 336. The wheel-lean control 336 may include a lean control lever 338 configured to move in fore and aft directions relative to its neutral to request that the front wheels 12 lean toward the left and right at a desired lean speed corresponding to the displacement of the lever 338 and a position sensor 340 (e.g., Hall-effect sensor) configured to sense the direction and magnitude of the displacement of the lever 338 relative to neutral. Exemplarily, the lever 338 may be included in a right pod of levers mounted to the forward end of the right armrest of the operator's seat in the operator's station 15. A left pod of levers may be similarly mounted to the left armrest. The levers of the right and left pods may be responsible for controlling various hydraulic functions. The lever 338 may be included in either pod.

Manual operation of the lever 338 causes the sensor 340 to output a signal that is received by the WLC 326 and that is indicative of the direction and magnitude of the displacement of the lever 338. The WLC 326 broadcasts a signal indicative of the direction and magnitude of the displacement of the lever 338 on the CAN bus 327, and HVC 322 receives that signal. The HVC 322 outputs a control signal to the applicable electro-hydraulic pilot valve 226 to cause the wheel-lean cylinder 58 to lean the wheels 12 in the requested direction at the requested lean speed.

The setpoint activation control 318 may include a push button 342 and a switch 344 configured to sense depression of the push button 342. The control 318 may be positioned in any suitable location, such as within the operator's station 20. For example, the control 318 may be supported on the lean control lever 338 within the operator's station 20, such as on a spherical knob of the lever 338, for movement relative thereto in response to manual operation (e.g., fingertip actuation) by the operator. In other examples, the control 318 may be positioned elsewhere within the operator's station 20, such as, for example, on a console (e.g., side console) or near a location of the operator's hand such as, for example, near a steering control or near a shifter.

The switch 344 may be, for example, a momentary switch such that manual operation of the push button 342 (i.e., depression of the push button 342) causes the switch 344 to output a wheel-lean request signal that is received by the WLC 326 and that is indicative of a request that the present wheel-lean angle of the wheels 12 assume automatically the wheel-lean angle setpoint. The wheel-lean request signal may be an on/off signal, such that it is devoid of direction and magnitude content, merely requesting that the present wheel-lean angle of the wheels 12 assume the setpoint automatically.

The WLC 326 broadcasts a wheel-lean request signal indicative of the request that the present wheel-lean angle of the wheels 12 assume automatically the wheel-lean angle setpoint, and the HVC 322 receives that signal. As such, in this exemplary embodiment, both the WLC 326 and the HVC 322 receive a wheel-lean request signal indicative of a request that the present wheel-lean angle of the wheels 12 assume automatically the wheel-lean angle setpoint in response to operation of the setpoint activation control 318.

As alluded to above, the setpoint activation control 318 may be supported on a lever knob. In such a case, the control 318 may be part of a button assembly including the push button 342 (as the single push button of the button assembly), the switch 344 positioned next to the push button 342, and a housing overmolded by the knob and having opposing halves coupled to one another using a pair of threaded fasteners and defining an interior region within which the push button 342 is partially positioned and within which the switch 344 is positioned. The push button 342 is pivoted to the housing and is exposed partially outside the housing and the knob through a hole in the knob for access to the push button 342 by the operator such that depression of the push button 342 by the operator pivots the push button 342 so as to activate the switch 344. A sleeve of the lever 338 integral with and underlying the knob is positioned over a hollow shaft through which the wires of the switch 344 extend downwardly from the switch 344. The lever 338 may be constructed such that the push button 342 is located in any suitable location relative to the knob, such as, for example, one-quarter of the way down the knob from its top. U.S. patent application Ser. No. 12/257,961, titled "Joystick Configuration" discloses an example of such a button assembly and is incorporated by reference herein.

In other embodiments of the button assembly, the button assembly may include two push buttons 342, two switches 344 positioned respectively next to the push buttons 342, and a housing overmolded by the knob and having opposing halves coupled to one another using a pair of threaded fasteners and defining an interior region within which the push buttons 342 are partially positioned and within which the switches 344 are positioned. The push buttons 342 are pivoted to the housing and are exposed partially outside the housing and the knob through respective holes in the knob for access to the push buttons 342 by the operator such that depression of the push buttons 342 by the operator pivots respectively the push buttons 342 so as to activate respectively the switches 344. A sleeve of the lever 338 integral with an underlying the knob is positioned over a hollow shaft through which the wires of the switches 344 extend downwardly through the switches 344. The lever 338 may be constructed such that the push buttons 342 are located in any suitable location relative to the knob, such as, for example, to one side of the knob three-quarters of the way down the knob from its top. U.S. patent application Ser. No. 12/257,961, titled "Joystick Configuration" discloses an example of such a button assembly and is incorporated by reference herein.

In the case of two push buttons 342, simultaneous manual operation of the push buttons 342 (i.e., depression of the push buttons 342) causes the switches 344 to output a wheel-lean request signal that is received by the WLC 326 and that is indicative of a request that the present wheel-lean angle of the wheels 12 assume automatically the wheel-lean angle setpoint. Alternatively, manual operation of just one of the push buttons 342 may be indicative of such a request.

In either embodiment of the button assembly, the angular position of the overmold body (including the knob and sleeve) with the button assembly therein may be adjustable to suit operator preference. A pair of set screws extends through a base of the overmold body radially inwardly into selected holes of the hollow shaft to set the angular position.

In an embodiment, the operator may input the wheel-lean angle setpoint using the one or more push buttons 342 on the lever 338. For example, in the case of two push-buttons, one push button 342 may be used to increment the angle, and the other push button 342 may be used to decrement the angle. In the case of a single push button, each depression of the push button 342 may be used to scroll between predetermined angles. To select an angle as the setpoint, the operator may depress and hold both push buttons 342 (in the case of two push buttons 342) or the single push button 342 (in the case of a single push button 342) for a predetermined period of time (e.g., three seconds).

The wheel-lean angle sensor 316 is positioned to sense the present wheel-lean angle of the front wheels 12. The location of the sensor 316 may be selected to afford suitable protection to the sensor 316 (including its wiring), if any, against external elements (brush, snow, ice, etc.).

In an example, the sensor 316 may be configured as a rotary sensor, in the form of a rotary encoder, mounted to sense an angle of rotation of a yoke 48 relative to either the axle 46 or the wheel-lean cylinder 58, such angle being indicative of the present wheel-lean angle. In an example, although both yoke pivot pins 49 are shown fixed to the axle 46 against movement relative thereto, a yoke pivot pin 49 (left or right) may be inserted into the axle 48 through the respective yoke 52 and fixed to the yoke 52 against movement relative thereto (e.g., with a cross bolt through the yoke 52 and the pin 49 and a nut holding the bolt in place), and the rotary sensor may mounted to the end of the pin 49 and to the axle 46 to sense relative rotation between the yoke 52 and the axle 46 (such as to the rearward end of the pin 49 and the rearward plate of the axle 46) (both pivot pins 49 may be so fixed respectively to the yokes 52). In another example, the rotary sensor may be mounted between a yoke 48 (left or right) and the respective yoke pivot pin 49 fixed to the axle 46 to sense relative motion therebetween. In such a case, the rotary sensor may be mounted at the yoke pivot pin 49 such that the sensor is integrated into the pin 49, or sufficient space may be created for mounting of the sensor at the pin 49 between the pin 49 and the yoke 48. In another example, such a sensor may be mounted between the rod end of the cylinder 58 and the left pin 62.

In another example, the sensor 316 may be configured, for example, as a linear displacement sensor (e.g., linear potentiometer) mounted to the wheel-lean cylinder 58 to sense the stroke of the cylinder, such stroke being indicative of the present wheel-lean angle. The linear displacement sensor 316 may be mounted internally for protection of the sensor. Alternatively, the linear displacement sensor 316 may be mounted externally to the cylinder 58.

In yet another example, the sensor 316 may be configured as a pair of inclinometers. The first inclinometer 356, shown diagrammatically in FIG. 2, may be mounted to the front axle 46 to sense a first angle of inclination $\epsilon$ relative to gravity, and the second inclinometer 358, shown diagrammatically in FIG. 2, may be mounted to one of the yokes 48 (e.g., the right yoke 48 below a mechanical stop) to sense a second angle of inclination $\zeta$ relative to gravity, wherein $\zeta$-$\epsilon$ is indicative of the present wheel-lean angle. The axle 46 may have a front plate and a rear plate 360 defining a space therebetween. The first inclinometer 356 may be mounted in the space within the axle 46 on the front vertical surface of the rear plate 360 for protection of the inclinometer 356 and its wiring.

The wheel-lean angle sensor 316 may be coupled electrically directly to the FLC 324 (or a different controller such as, for example, the HVC 322). In the case of a linear displacement sensor or a rotary sensor as the sensor 316, the sensor 316 generates a wheel-lean angle signal indicative of the present wheel-lean angle sensed by the sensor 316. The FLC 324 receives this signal and broadcasts on the CAN bus 327 a signal (itself a present wheel-lean angle signal) indicative of the present wheel-lean angle. The HVC 322 receives this signal.

In the case of a pair of inclinometers as the sensor 316, the first inclinometer generates a signal indicative of the first angle of inclination $\beta$, and the second inclinometer generates a signal indicative of the second angle of inclination $\gamma$. The FLC 324 receives those signals, and calculates a difference between them, i.e., $\gamma$-$\beta$, such difference being indicative of the present wheel-lean angle. Based on this calculation, the FLC 324 broadcasts on the CAN bus 327 a signal (itself a present wheel-lean angle signal) indicative of the present wheel-lean angle. The HVC 322 receives this signal.

In response to receipt of the request for the present wheel-lean angle of the wheels 12 to assume automatically the wheel-lean angle setpoint, the HVC 322 performs feedback control of the present wheel-lean angle such that the present wheel-lean angle assumes the wheel-lean angle setpoint. As part of the feedback control scheme, the HVC 322 monitors the present wheel-lean angle sensed by the wheel-lean angle sensor 316, and uses the stored setpoint and the present wheel-lean angle to determine what needs to occur, if anything, for the present wheel-lean angle to assume the setpoint. In response to the wheel-lean request signal, it determines if the present wheel-lean angle is at the wheel-lean angle setpoint (e.g., if the present wheel-lean angle is within + or − a tolerance about the setpoint, such as + or −0.25 degree). If the present wheel-lean angle is at the setpoint, the HVC 322 determines not to output a control signal to either of the pilot valves 226, so as not to change the present wheel-lean angle. However, if the present wheel-lean angle is not at the setpoint, the HVC 322 outputs a control signal to the respective pilot valve 226 causing the actuator 210 to move the wheels 12 automatically such that the present wheel-lean angle assumes the wheel-lean angle setpoint.

The HVC 322 determines on which side of the wheel-lean angle setpoint is the present wheel-lean angle using the stored setpoint and the present wheel-lean angle. From this information, the HVC 322 determines which pilot valve 226 to activate.

The HVC 322 is coupled electrically to the two pilot valves 226, and outputs the control signal (e.g., a current) to the appropriate pilot valve 226. The HVC 322 outputs the control signal to a first of the pilot valves 226 if the present wheel-lean angle is on a first side of the wheel-lean angle setpoint and outputs the control signal to a second of the pilot valves if the present wheel-lean angle is on a second side of the wheel-lean angle setpoint opposite to the first side. The HVC 322 ceases outputting the control signal when the present wheel-lean angle assumes the wheel-lean angle setpoint.

The control signal may have a constant current level (e.g., a constant average current level, or a pulse-width modulation signal) until the present wheel-lean angle assumes the setpoint, or may take the form of a signal with different current levels depending on how close the present wheel-lean angle is to the setpoint. In the case of a constant current level, the control signal may be ceased (i.e., zero current level) once it is determined that the present wheel-lean angle is at the setpoint.

The current level may be de-rated to slow movement of the wheels 12 as the present wheel-lean angle approaches the setpoint, to prevent or otherwise minimize overshooting of the setpoint. Exemplarily, if the present wheel lean angle is within an outer range relative to the setpoint, the current may be at a higher non-zero first current level resulting in higher flow to the cylinder 58 and thus faster movement of the wheels 12 and corresponding change in the present wheel-lean angle toward the setpoint. If the present wheel lean angle is within an inner range relative to the setpoint, the current may be ramped down or otherwise at a lower second non-zero current level as the present wheel-lean angle approaches the setpoint, resulting in lower flow to the cylinder 58 and thus slower movement of the wheels 12 and corresponding change in the present wheel-lean angle toward the setpoint. The control signal may be ceased (i.e., zero current level) once it is determined that the present wheel-lean angle is at the setpoint. The wheels 12 may thus come to a soft stop. The HVC 322 may thus be configured to de-rate a current level of the control signal between non-zero current levels as the present wheel-lean angle approaches the wheel-lean angle setpoint.

In an example, the wheel-lean angle setpoint may be neutral. In such a case, the current level may be de-rated to slow movement of the wheels 12 as the present wheel-lean angle approaches neutral, to prevent or otherwise minimize overshooting of neutral. Exemplarily, if the present wheel lean angle is within an outer range relative to neutral, the current may be at a higher non-zero first current level resulting in higher flow to the cylinder 58 and thus faster movement of the wheels 12 and corresponding change in the present wheel-lean angle toward neutral. If the present wheel lean angle is within an inner range relative to neutral (e.g., + or −4 or 5 degrees relative to neutral), the current may be ramped down as the present wheel lean angle approaches neutral. The control signal may be ceased (i.e., zero current level) once it is determined the present wheel-lean angle is at neutral. The wheels 12 may thus come to a soft stop. The HVC 322 may thus be configured to de-rate a current level of the control signal between non-zero current levels as the present wheel-lean angle approaches neutral.

The control unit 310 may be configured to have a single wheel-lean angle setpoint or multiple wheel-lean angle setpoints. For example, there may be two setpoints: a zero wheel-lean angle setpoint (e.g., for transit) and a non-zero wheel-lean angle for a job. In another example, there may be three setpoints: a zero wheel-lean angle setpoint (e.g., for transit), a first non-zero wheel-lean angle for a first job (e.g., ditching), and a second non-zero wheel-lean angle setpoint for a second job (e.g., road maintenance), in which case it may be useful for an operator to activate the first non-zero setpoint when performing the first job at a first job site, activate the first non-zero setpoint when roading from the first job site to a second job site, and activate the second non-zero setpoint when performing the second job at the second job site. The control unit 310 could be programmed with any number of wheel-lean angle setpoints. An operator control within the operator's station (e.g., a switch in the form of, for example, a button or other switch) may be used to toggle between two or more setpoints. There may be other such buttons for selecting any of a number of setpoints. Other inputs may be used to select the proper setpoint, such as, for example, a steering angle (e.g., based on one or both of the articulation angle and the front wheel steering angle), as discussed below, or ground speed (e.g., if the ground speed of the vehicle reaches a predetermined roading speed, the wheel-lean angle may be commanded to neutral).

Activation of the wheel-lean angle setpoint may occur automatically. For example, as the operator turns the vehicle 10 around at the end of a pass, when a steering angle is greater than a predetermined first steering angle (e.g., 30 degrees), the front wheels 12 are leaned automatically into the turn from a first wheel-lean angle setpoint (e.g., whatever the setpoint is prior to the turn) to a second wheel-lean angle setpoint (e.g., full-lean setpoint in the direction of the turn such as, for example, 20 degrees). The first wheel-lean setpoint may be stored in memory of the HVC 322. The second wheel-lean setpoint may be predetermined and stored in memory of the HVC 322 such that the second wheel-lean setpoint is not operator selectable, although in other embodiments it may be operator-selectable. The front wheels 12 are then returned to the first wheel-lean angle setpoint when the steering angle drops below a predetermined second steering angle (e.g., 20 degrees), which may be less than the predetermined first steering angle to build in some hysteresis.

The steering angle $\alpha$ may be determined based on one or both of the articulation angle $\beta$ of the vehicle 10 and a front wheel steering angle $\gamma$. Preferably, the steering angle $\alpha$ is just the front wheel steering angle. Alternatively, it may be just the articulation angle, or a combination of the articulation angle $\beta$ and the front wheel steering angle $\gamma$ (i.e., $\alpha=\beta+\gamma$).

Figure 6A:
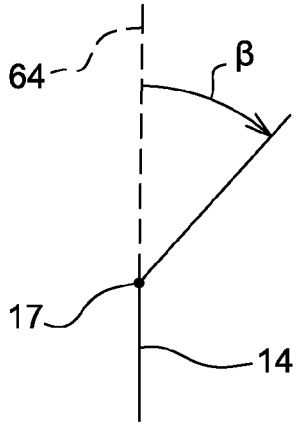
FIG. 6A is a diagrammatic view showing an articulation angle.

Referring to FIG. 6A, an articulation angle sensor 350 coupled electrically to the FLC 324 may sense the articulation angle $\beta$. The articulation angle $\beta$ may be defined as the angle of articulation of the front section 16 relative to the rear section 14 (or vice versa) from the straight orientation 64 of the rear and front sections 14, 16. The articulation angle sensor 350 may be a rotary encoder positioned at the articulation joint 17 to sense the articulation angle and convert that angle into a voltage indicative of the articulation angle. The FLC 324 may receive that voltage, and determine the articulation angle using a look-up table stored in memory of the FLC 324, interpolating as needed. The look-up table may be calibrated with voltages and corresponding articulation angles at the zero position (straight orientation 64), the full left articulation position, and the full right articulation position (which assumes a linear relationship between zero and full articulation). An equation or other suitable methods may be used instead of a look-up table to determine the articulation angle $\beta$.

Figure 6B:
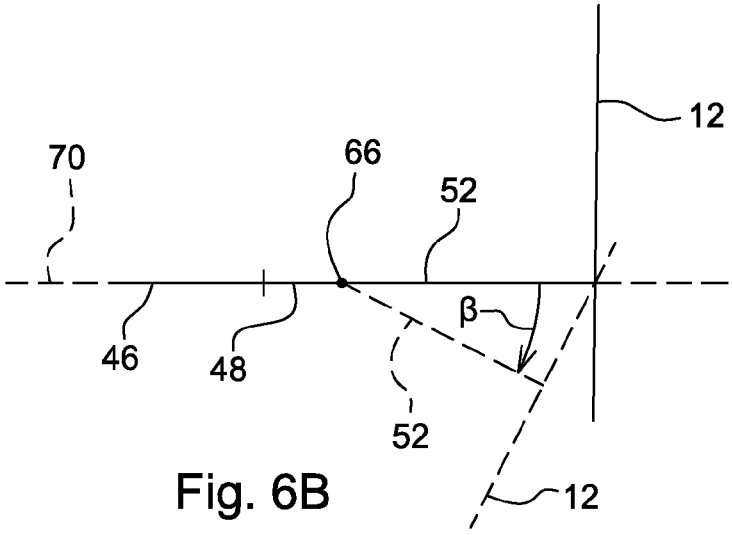
FIG. 6B is a diagrammatic view showing a front wheel steering angle.

Referring to FIG. 6B, the front wheel steering angle $\gamma$ may be determined in a number of ways. For example, a single front wheel steering angle sensor 352 coupled electrically to the FLC 324 may be positioned next to a first of the front wheels 12 (left or right, illustratively the right) at the steering joint 66 of that wheel 12 to sense the steering angle $\delta$ of that wheel 12. The front wheel steering angle sensor 352 may be a rotary encoder positioned at either one of the two kingpins of the steering joint 66 of the first front wheel 12, such as, for example, the upper kingpin, to sense the rotation of the kingpin, or, stated otherwise, the angular displacement of the spindle 52 relative to the yoke 48 from the position of the spindle 52 when the first front wheel 12 is perpendicular to an axis 70 of the axle 46. Such may be the angle sensed by the sensor 352. The sensor 352 may convert that angle into a voltage.

The FLC 324 may receive that voltage, and use a look-up table stored in memory of the FLC 324 to determine the front wheel steering angle $\gamma$. During calibration, the look-up table is generated by learning the voltage at three steering positions, i.e., straight (i.e., angle $\delta$ is zero degrees), the right full steering position (i.e., at the right mechanical steering stop), and the left full steering position (i.e., at the left mechanical steering stop), and correlating respectively those voltages to front wheel steering angles $\gamma$ of zero degrees, +40 degrees, and −40 degrees (the sign convention of $\gamma$ could be reversed so long as consistent with the sign convention of the articulation angle to the extent $\beta$ and $\gamma$ are considered together) (+40 degrees and −40 degrees are merely non-limiting exemplary values). As alluded to above, when the front wheels 12 are turned from zero degrees, the inboard front wheel 12 will angle more than the outboard front wheel 12 to discourage skidding. As such, the actual steering angles of the right and left front wheels 12 at the right full steering position and the left full steering position will be different from +40 degrees and −40 degrees (e.g., the steering angle of the inboard wheel may be less than 40 degrees in the direction of the turn and the outboard wheel may be greater than 40 degrees in the direction of the turn). Nonetheless, +40 degrees and −40 degrees are taken to be reasonable approximations of the front wheel steering angle $\gamma$ at the right and left full steering positions the front wheel steering angle $\gamma$. Likewise, the interpolated values are taken be reasonable approximations of the front wheel steering angle $\gamma$ at intermediate positions. The look-up table may thus be calibrated with three voltage values at the three positions mentioned.

Upon receiving a voltage value from the sensor 352, the FLC 324 may determine the front wheel steering angle $\gamma$ using the look-up table, interpolating as needed. When the sensed angle $\delta$ is zero degrees (i.e., zero degrees + or − a tolerance such as, for example, 2 degrees), the FLC 324 may determine that the front wheel steering angle $\gamma$ is zero degrees. When the sensed angle $\delta$ is non-zero at one of the right or left full steering positions, the FLC 324 may determine that the front wheel steering angle $\gamma$ is + or −40 degrees. At intermediate positions, the FLC 324 may interpolate to determine the front wheel steering angle $\gamma$. An equation or other suitable methods may be used instead of a look-up table to determine the front wheel steering angle $\gamma$.

If both the articulation angle and the front wheel steering angle are used to determine the steering angle, the two angles may be added together (i.e., $\alpha=\beta+\gamma$) by the FLC 324, in which case angling to the left or the right relative to the respective datum may be selected as positive for purposes of sign convention. For sake of an example, assume angling to the right is taken as positive, and, if the articulation angle $\beta$ is 20 degrees (to the right) and the front wheel steering angle $\gamma$ is −20 degrees (to the left), the steering angle $\alpha$ would be $20+(-20)=0$ degrees.

As such, the FLC 324 is configured to determine the steering angle $\alpha$ based on the articulation angle $\beta$ associated with the work vehicle 10 and/or the front wheel steering angle $\gamma$ associated with the front wheels 12.

The FLC 324 receives input signals from the sensors 350 and 352, determines the steering angle $\gamma$ accordingly, and outputs the steering angle $\gamma$ on the CAN bus 327. The HVC 322 determines if the steering angle $\gamma$ is greater than the predetermined first steering angle stored in memory thereof, and, if so, outputs a control signal causing the wheel-lean actuator 210 to move the front wheels 12 from the first wheel-lean setpoint stored in memory of the HVC 322 to the second wheel-lean setpoint stored in memory of the HVC 322. The HVC 322 determines if the steering angle is below the predetermined second steering angle stored in memory thereof, and, if so, outputs a control signal causing the wheel-lean actuator 210 to move the front wheels 12 from the second wheel-lean angle back to the first wheel-lean angle.

It is to be understood that, in the case where the front wheel steering angle $\gamma$ is to be used in the determination of the steering angle $\alpha$, the value of the predetermined first steering angle will be based on the design method selected for determining the steering angle $\alpha$. One method of determining the steering angle may result in one value (e.g., 30 degrees), whereas another method may result in another value (e.g., 33.33 degrees), as one of ordinary skill in the art will recognize. For example, in other embodiments, the steering angle $\alpha$ may be determined using inputs from two front wheel steering angle sensors 352, one to sense the steering angle $\delta$ of the right front wheel and the other to sense the steering angle $\delta$ of the left front wheel.

In another example of automatic activation, when the wheel-lean angle is near neutral, it is considered that neutral is desired in which case the front wheels 12 are moved to assume neutral automatically. More particularly, the HVC 322 is configured to determine if the present wheel-lean angle is at an angle within a range about neutral (e.g., + or −2 degrees) for a predetermined period of time after manual wheel-lean activation (e.g., 2 seconds) by use of a timer 354 of the HVC 322. If so, the HVC 322 outputs a control signal causing the wheel-lean actuator 210 to move the front wheels 12 to neutral. An on/off control may be included to enable or disable this automatic neutral-activation mode. The HVC 322 may automatically disable the automatic neutral-activation mode if a steering angle $\alpha$ is a predetermined steering angle (e.g., 20 or 30 degrees), the steering angle $\alpha$ being a function of one or both of the front wheel steering angle $\gamma$ and the articulation angle $\beta$, as discussed herein.

In another example of automatic activation, if a speed is at least a non-zero threshold speed, the wheel-lean angle may be commanded to neutral. In such a case, the control unit 310 is coupled to a speed sensor 362 positioned to sense an indication of a speed. The control unit 310 is configured to determine if the speed is at least the non-zero threshold speed, and, if so, output a control signal causing the wheel-lean actuator 210 to move the front wheels 12 to neutral.

The threshold speed may be ground speed, such as, for example, a roading speed (e.g., 10 miles per hour). The speed sensor 362 may be a ground speed sensor positioned to sense an indication of a ground speed of the vehicle 10. In an example, the speed sensor may be a transmission output shaft speed sensor positioned to sense the rotational speed of the output shaft of a transmission of the rear section 14, the ground speed calculated based on that output shaft speed taking into account vehicle geometry downstream of that shaft. In another example, the speed sensor may be a tandem axle speed sensor positioned to sense the rotational speed of one of the two tandem axles, the ground speed calculated based on that axle speed taking into account vehicle geometry downstream of that axle (a no-turning condition in which the wheels 13 of the left and right tandems 25 are equal may be assumed). In yet another example, the speed sensor may be a radar sensor configured to sense actual ground speed using radar (e.g., one that shoots the ground with radar). Zero wheel slippage may be assumed, in the case of a transmission output shaft speed sensor, a tandem axle speed sensor, or other speed sensor that senses ground speed indirectly. The control unit 310 is thus configured to determine if the ground speed is at least the non-zero threshold speed, and, if so, output the control signal causing the wheel-lean actuator 210 to move the traction wheel to neutral.

The FLC 324 is coupled to the speed sensor 362 and receives from the speed sensor 362 a speed signal indicative of the ground speed of the vehicle 10. The FLC 324 broadcasts on the CAN bus 327 a signal (itself a speed signal) indicative of the speed. The HVC 322 receives this signal, and determines if the ground speed is at least the non-zero threshold speed stored in memory thereof, and, if so, outputs the control signal causing the wheel-lean actuator 210 to move the traction wheel to neutral.

In yet another example of the wheel-lean angle sensor 316, the sensor 316 may be configured as one or more switches positioned at or near the wheel-lean setpoint to indicate when such setpoint has been reached.

For example, if the wheel-lean setpoint is left or right full-travel, the sensor 316 may include a single switch positioned at that full-travel position to indicate when that full-travel setpoint has been reached. In response to receipt of the request for the present wheel-lean angle of the wheels 12 to assume automatically the wheel-lean angle setpoint, the HVC 322 performs feedback control of the present wheel-lean angle such that the present wheel-lean angle assumes the wheel-lean angle setpoint. As part of the feedback control scheme, the HVC 322 monitors the state of the switch based on a signal broadcast by the FLC 324 on the CAN 327. For example, if the switch is OFF (or vice versa), the FLC 324 broadcasts a corresponding signal on the CAN 327 (or no signal at all) (itself a present wheel lean angle signal) indicating that the present wheel-lean angle is not at the setpoint, and the HVC 322 determines that the present wheel-lean angle is not at the setpoint and outputs a control signal to the respective pilot valve 226 causing the actuator 210 to move the wheels 12 toward the setpoint. If the switch is ON (or vice versa), the FLC 324 receives this signal from the switch and broadcasts on the CAN bus 327 a signal (itself a present wheel lean angle signal) indicative of the present wheel-lean angle at the full-travel position. The HVC 322 receives this signal, and determines that the present wheel-lean angle is at the setpoint and determines not to output a control signal to either of the pilot valves 226, so as not to change the present wheel-lean angle.

The sensor 316 may be configured as two switches, with one of the switches positioned at left full-travel and the other switch positioned at right full-travel. The wheel-lean setpoint may thus be either left or right full-travel, as determined by an operator (e.g., through the operator interface 332) or automatically. The control unit 310 may operate as described above to achieve the selected full-travel setpoint.

The wheel-lean setpoint may be neutral, in which case the sensor 316 may be configured as a single switch positioned at neutral, or as two switches positioned on either side of neutral to minimize overshoot of neutral (e.g., +1 degree and −1 degree). The control unit 310 may operate as described above to achieve the neutral setpoint with the addition that the control unit 310 (e.g., the HVC 322) may track on which side of neutral is the present wheel-lean angle in order to determine which direction to move the wheels 12. The speed at which the HVC 322 commands movement of the wheels 12 toward the neutral setpoint may be relatively low to minimize overshoot.

The wheel-lean sensor 316 may thus be configured as a continuous wheel-lean sensor (e.g., rotary sensor, linear displacement sensor, or two inclinometers) or a switch wheel-lean sensor (e.g., one switch, two switches, or more depending, for example, on the number and position of the setpoints that can be selected).

The control unit 310 may be configured in a wide variety of ways. It may have a single controller, or two or more controllers. In the case of two or more controllers, specific controller inputs, outputs, and responsibilities may be assigned in a wide variety of ways, the arrangement disclosed herein being one such possible way.

While the disclosure has been illustrated and described in detail in the drawings and foregoing description, such illustration and description is to be considered as exemplary and not restrictive in character, it being understood that illustrative embodiments have been shown and described and that all changes and modifications that come within the spirit of the disclosure are desired to be protected. It will be noted that alternative embodiments of the present disclosure may not include all of the features described yet still benefit from at least some of the advantages of such features. Those of ordinary skill in the art may readily devise their own implementations that incorporate one or more of the features of the present disclosure and fall within the spirit and scope of the present invention as defined by the appended claims.

What is claimed is:

1. A work vehicle, comprising:

an axle, a traction wheel coupled to the axle to move relative thereto to lean at a present wheel-lean angle from neutral, a wheel-lean angle sensor positioned to sense an indication of the present wheel-lean angle, a setpoint activation control, a wheel-lean actuator coupled to the traction wheel to lean the traction wheel relative to neutral, and a control unit coupled to the wheel-lean angle sensor, the setpoint activation control, and the wheel-lean actuator, the control unit configured to perform feedback control of the present wheel-lean angle causing the wheel-lean actuator to move the traction wheel automatically such that the present wheel-lean angle assumes the wheel-lean angle setpoint in response to operation of the setpoint activation control.

2. The work vehicle of claim 1, wherein the control unit is configured to:

store the wheel-lean angle setpoint, receive one or more signals indicative of the present wheel-lean angle in response to operation of the wheel-lean angle sensor and a wheel-lean request signal indicative of a request that the present wheel-lean angle assume the wheel-lean angle setpoint in response to operation of the setpoint activation control, determine if the present wheel-lean angle is at the wheel-lean angle setpoint in response to the wheel-lean request signal, and if not, output a control signal causing the wheel-lean actuator to move the traction wheel such that the present wheel-lean angle assumes the wheel-lean angle setpoint.

3. The work vehicle of claim 2, wherein the control unit is configured to de-rate a current level of the control signal between non-zero current levels as the present wheel-lean angle approaches the wheel-lean angle setpoint.

4. The work vehicle of claim 1, wherein the wheel-lean angle setpoint is a zero wheel-lean angle relative to neutral.

5. The work vehicle of claim 1, further comprising an operator interface configured to receive the wheel-lean angle setpoint from a human operator.

6. The work vehicle of claim 1, wherein the wheel-lean angle sensor is configured as a linear displacement sensor.

7. The work vehicle of claim 1, wherein the wheel-lean angle sensor comprises a first inclinometer and a second inclinometer.

8. The work vehicle of claim 1, wherein the wheel-lean angle sensor is configured as a rotary sensor.

9. The work vehicle of claim 1, wherein the control unit is configured to determine on which side of the wheel-lean angle setpoint is the present wheel-lean angle.

10. The work vehicle of claim 9, wherein the wheel-lean actuator comprises an electro-hydraulic first pilot valve and an electro-hydraulic second pilot valve, and the control unit is coupled electrically to the first and second pilot valves and is configured to output a control signal to the first pilot valve if the present wheel-lean angle is on a first side of the wheel-lean angle setpoint and output the control signal to the second pilot valve if the present wheel-lean angle is on a second side of the wheel-lean angle setpoint opposite to the first side.

11. The work vehicle of claim 1, wherein the control unit is configured to have multiple wheel-lean angle setpoints.

12. The work vehicle of claim 1, wherein the control unit is configured to determine if a steering angle is greater than a predetermined first steering angle, and, if so, output a control signal causing the wheel-lean actuator to move the traction wheel from a first wheel-lean angle setpoint to a second wheel-lean angle setpoint.

13. The work vehicle of claim 12, wherein the control unit is configured to determine if the steering angle is below a predetermined second steering angle, and, if so, output a control signal causing the wheel-lean actuator to move the traction wheel back to the first wheel-lean angle setpoint.

14. The work vehicle of claim 12, wherein the work vehicle is an articulated work vehicle, and the control unit is configured to determine the steering angle based on a steering angle associated with the traction wheel but not on an articulation angle associated with the work vehicle.

15. The work vehicle of claim 12, wherein the work vehicle is an articulated work vehicle, and the control unit is configured to determine the steering angle based on an articulation angle associated with the work vehicle but not on a steering angle associated with the traction wheel.

16. The work vehicle of claim 12, wherein the work vehicle is an articulated work vehicle, and the control unit is configured to determine the steering angle based on an articulation angle associated with the work vehicle and a steering angle associated with the traction wheel.

17. The work vehicle of claim 1, wherein the control unit is configured to determine if the present wheel-lean angle is at an angle within a range about neutral for a predetermined period of time after manual wheel-lean activation, and, if so, output a control signal causing the wheel-lean actuator to move the traction wheel to neutral.

18. The work vehicle of claim 1, further comprising a speed sensor positioned to sense an indication of a speed, wherein the control unit is coupled to the speed sensor and is configured to determine if the speed is at least a non-zero threshold speed, and, if so, output a control signal causing the wheel-lean actuator to move the traction wheel to neutral.

19. The work vehicle of claim 18, wherein the speed sensor is a ground speed sensor and the speed is a ground speed such that the ground speed sensor is positioned to sense an indication of a ground speed of the work vehicle, and the control unit is configured to determine if the ground speed is at least the non-zero threshold speed, and, if so, output the control signal causing the wheel-lean actuator to move the traction wheel to neutral.

20. The work vehicle of claim 1, wherein the work vehicle is a motor grader.

* * * * *